US005652945A

United States Patent [19]

Thayer et al.

[11] Patent Number: 5,652,945

[45] Date of Patent: Jul. 29, 1997

[54] AUTOMATIC MEASUREMENT OF CLEANING BRUSH NIP WIDTH FOR PROCESS CONTROL AND/OR DIAGNOSTICS

[75] Inventors: Bruce E. Thayer; Dennis G. Gerbasi, both of Webster; Christopher B. Miller, Rochester, all of N.Y.

[73] Assignee: Xerox Corporation, Stamford, Conn.

[21] Appl. No.: 650,499

[22] Filed: May 20, 1996

[51] Int. Cl.[6] ..... G03G 21/00

[52] U.S. Cl. ..... 399/34; 399/345; 399/354

[58] Field of Search ..... 399/34, 71, 353, 399/354, 345, 9

[56] References Cited

U.S. PATENT DOCUMENTS 5,381,218 1/1995 Lundy .

5,450,186 9/1995 Lundy .

5,546,177 8/1996 Thayer .

*Primary Examiner*—R. L. Moses

*Attorney, Agent, or Firm*—T. L. Fair

[57] ABSTRACT

A method to evaluate the cleaning performance of brush cleaners by measuring the brush to photoreceptor nip width (e.g cleaning footprint or contact zone) using an ESV sensor or ETAC sensor. This nip width measurement is automatically made using one of the sensing devices. The nip width measurement is converted into diagnostic information using a software algorithm or similar mode of conversion. The diagnostic information can be used in a variety of ways such as a diagnostic tool for a technical representative to warn against the end of brush life, to adjust cleaner biases for automatic changes in setup to achieve better cleaning, to predict brush replacement, to correct brush BPI (i.e. brush to photoreceptor interference) for an under or over engaged brush.

16 Claims, 4 Drawing Sheets

AUTOMATIC MEASUREMENT OF CLEANING BRUSH NIP WIDTH FOR PROCESS CONTROL AND/OR DIAGNOSTICS

BACKGROUND OF THE INVENTION

This invention relates to an electrostatographic printing machine and more particularly concerns an automatic measurement of a cleaning brush nip width for process control and/or diagnostics.

One of the significant factors in the performance of a cleaning brush is the number of brush fiber tips which are available to contact toner entering the zone formed by the interference of the brush to the photoreceptor. The higher the number of available fibers (fiber strikes) to clean, the better the cleaning and the more robust the cleaner will be to stress inputs and environments. Fiber strikes are a function of the brush diameter, brush speed and brush to photoreceptor interference (i.e. BPI). At any point in time only the speeds and interference can be varied. Over time, however, the diameter of the brush will shrink with usage. This is due to the mechanical set of the brush fibers due to repeated compression in the photoreceptor nip and, if present, detoning roll or flicker bar interferences. Additionally, the brush diameter will decrease due to the accumulation of toner within the brush. (Toner accumulated near the core of the brush holds the fibers in deflected positions.)

Verification of the interference of a new brush to a photoreceptor or to determine the shrinkage of a used brush (and the loss of fiber strikes) is often determined by measuring the width of the cleaning brush nip(s) to the photoreceptor. The nip width was manually measured directly from the photoreceptor surface or from a tape transfer that provided a permanent record of the testing conditions when the brush diameter was known. A simple equation relates the nip width to the brush diameter and the interference, $(\frac{1}{2}\text{ Dia.})^2=(\frac{1}{2}\text{ Dia.}-\text{BPI})^2+(\frac{1}{2}\text{ Nip Width})^2$. Unfortunately, the present procedure for measuring the nip width procedure is too dirty and complicated for use as a field service procedure.

The following disclosures may be relevant to various aspects of the present invention and may be briefly summarized as follows:

U.S. Pat. No. 5,450,186 to Lundy discloses a flexible cleaner brush belt that increases brush belt life by flexing away from the photoreceptor when not in use. The flexible belt is lifted away from contact with the photoreceptor and placed back into contact with the photoreceptor by a camming device. A camming device attached to linkages, increases the diameter of the flexible brush belt to lift the brush belt away from contact with the imaging surface. The camming device urges the belt brush back into contact with the imaging surface by decreasing the diameter of the brush belt. This movement of the brush belt increases the brush belt life and does not cause print quality defects, excessive toner clouding, or loss of machine productivity.

U.S. Pat. No. 5,381,218 to Lundy discloses a conductive flexible cleaner brush belt having a plurality of detoning stations to remove particles from the brush fibers. At least one of the rollers about which the flexible belt brush is mounted has a small diameter for spreading the brush fibers apart. This spreading of the fibers creates a node affect as the fibers rebound, adjacent fibers open creating a moving node affect. This node affect facilitates detoning of the brush by an air vacuum as air removes the particles from the brush fibers.

SUMMARY OF INVENTION

Briefly stated, and in accordance with one aspect of the present invention, there is provided a method for measuring a width of a contact zone between a surface, having movement, and a cleaner brush, having a detoning member, the surface having a toner image thereon, the contact zone having particles of the toner image removed from the surface, comprising: developing the toner image on the surface, the toner image having sufficient width to overlap the cleaner brush; moving the toner image to be directly aligned with the cleaner brush; stopping the movement of the surface; rotating the cleaner brush against the surface to remove the toner image from the surface in the contact zone; moving the toner image out of direct alignment with the cleaner brush; measuring a width of the contact zone automatically; and converting the measurement of the width of the contact zone for diagnostic analysis and process control.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 5:
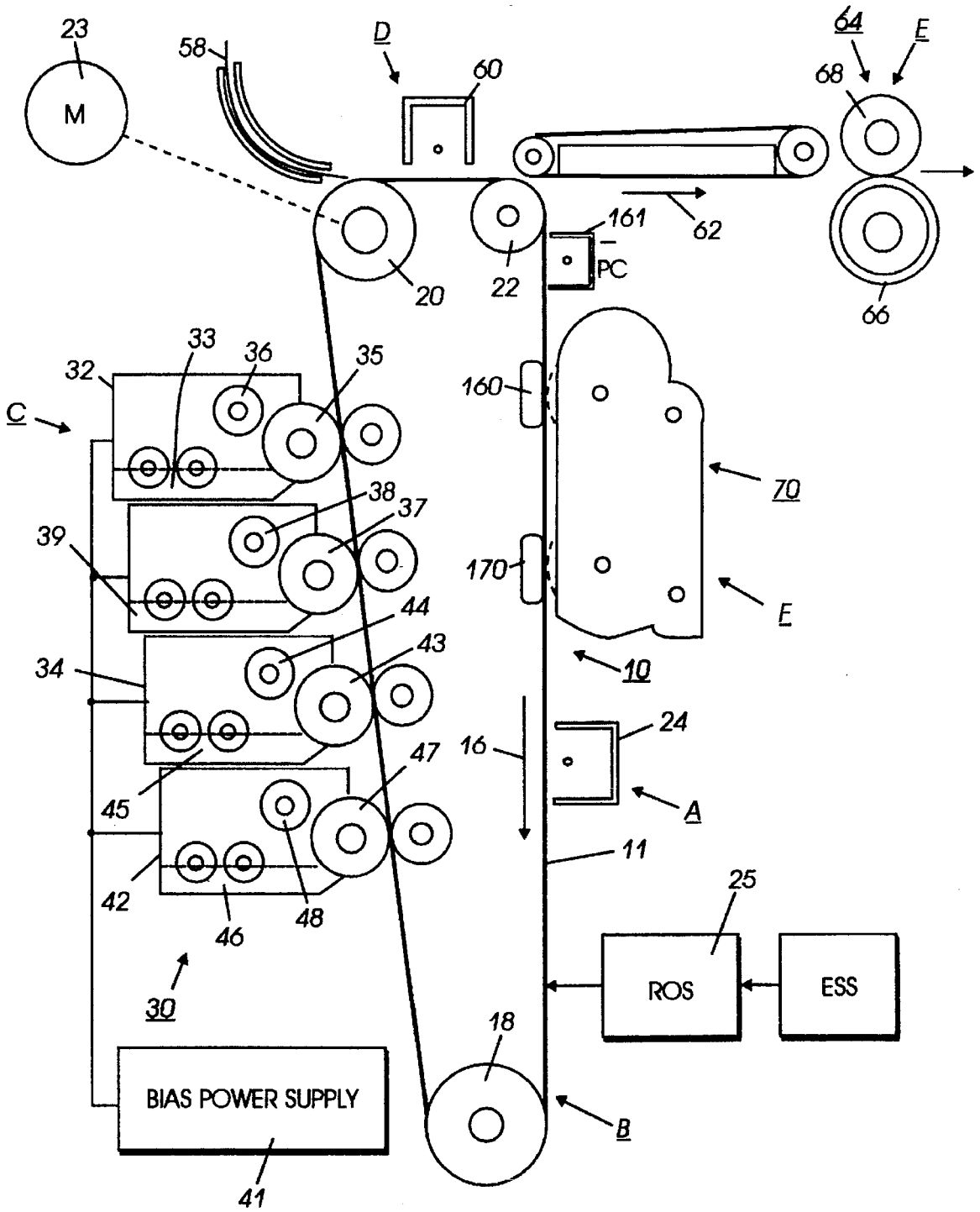
FIG. 5 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 5 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 5, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. Backers 160 and 170 are located directly opposed from the cleaner brushes on the opposite side of the photoreceptor 10. A preclean corotron 161 is located upstream from the cleaning system 70.

In the present invention, an automated measurement of cleaning brush nip width is disclosed for use in copiers and printers. The measurement of the nip width indicates the diameter of the brush, after some period of use, which can be used to determine the fiber strikes available and the potential life remaining in the brush. The automated procedure, of the present invention, allows the technical representative (or equivalent) to diagnose the cause of a cleaning failure.

However, more importantly, in the present invention, this automated procedure is used to predict the remaining cleaner brush life and alert the technical representative (or like) to the optimum time to replace the cleaning brush (e.g. roller or other like cleaning device). Presently, all brushes are replaced or vacuumed to remove accumulated toner at a fixed preventive maintenance interval or they are run until they fail. The only significant failure mode of the brush is the loss of photoreceptor/brush contact normally due to the brush diameter reduction over time. And, this reduction in diameter is a function of the rate of toner input to the cleaner and the ambient environmental conditions, both of which vary greatly over the population of machines. As a result, many brushes are replaced or serviced well before the end of their useful lives in order to avoid a costly unscheduled maintenance call. If the brushes are run to failure, an unscheduled maintenance call will result unless the failure is detected by the technical representative and the brush replaced or serviced before the customer complains of poor copy quality. Periodic measurement of the brush nip width, made automatically by the copier would generate a nearing end of brush life warning. This trigger to replace or service the degraded cleaning brushes would be given when the nip width had fallen below a predetermined value. The warning of brushes nearing the end of their lives could be given to the tech rep at a call through a high service frequency items (HSFI) check or to the service branch through a remote interactive communications (RIC) call.

Another option for the use of automated nip width measurement is to adapt the brush operating parameters to compensate for degrading performance from decreasing brush diameter. For example, the brush speed could be increased, the photoreceptor interference increased or the bias on an electrostatic brush could be increased to restore performance. Such adaptive changes to the cleaner operation may have the potential to significantly prolong the life of cleaner brushes. Compensating for a failing cleaner brush through changes in other parameters should at least provide a cushion of adequate cleaner operation to enable avoidance of an unscheduled maintenance call.

Figure 1A:
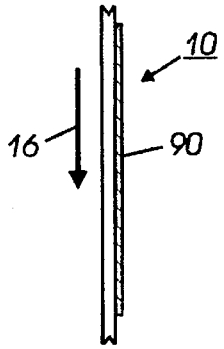
FIGS. 1A–1C show, sequentially, an elevational schematic view of a developed toner patch on a photoreceptor, cleaning a nip width of the toner patch with a cleaner (FIG. 1B) and using the present invention, measuring the nip width cleaned from the toner patch by the cleaner.
Figure 1B:
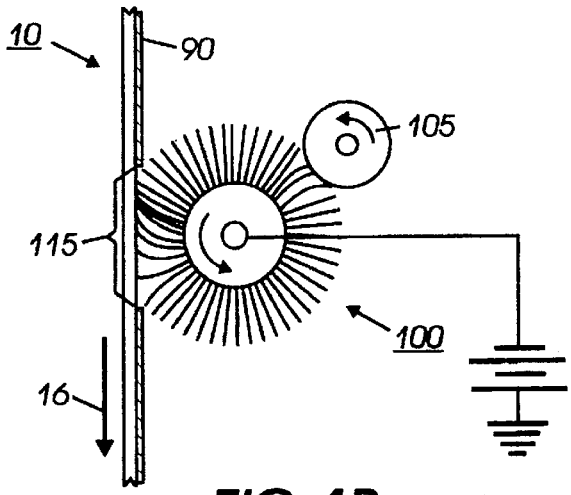
Figure 1C:
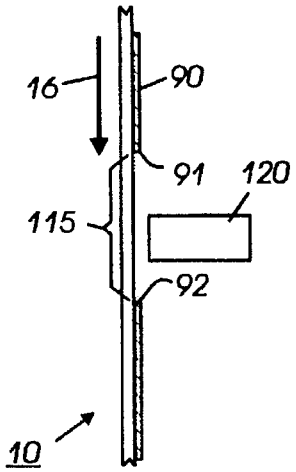

Reference is now made to FIGS. 1A–1C which shows sequentially the operation of the present invention to measure cleaner nip width. In the present invention, to implement an automatic nip width 115 measurement, the cleaner (e.g. brush or roller) and photoreceptor 10 must be independently driven. The nip width measurement is made when the electrostatographic printer is in a special mode, such as during cycle up or cycle out.

With continuing reference to FIGS. 1A–1C, the following basic procedure is required for automatic measurement by the present invention. First, a toner patch 90 of sufficient width to overlap the brush 100 (or brushes or other like cleaner) is developed on the photoreceptor 10 surface. (This toner patch 90 has a predetermined length, in that the toner patch is long enough to span the brush nip.) (See FIG. 1A.) Next, the toner patch is moved under the brush. The toner of the toner patch must not be removed by the brush until the photoreceptor 10 is stationary. Next the brushes are rotated against the stationary photoreceptor. Then the toner patch is removed from contact with the cleaner brush. At this stage, the width of the brush to photoreceptor nip (i.e. the area of contact between the photoreceptor and brush) is measured. This is done, in the present invention, by converting the time it takes for the edges of a cleaned nip zone or zones on the photoreceptor to pass under a sensor to nip width or widths. The nip width is equivalent to the velocity of the photoreceptor multiplied by the time form the lead edge 91 (see FIG. 1C) to the trail edge 92 (see FIG. 1C) for the cleaned nip to pass under the sensor 120. (i.e. The sensor 120 determines the nip width 115 located between the edges of the cleaned nip zone.) In the present invention this measurement can be made by either an ESV (electrostatic voltmeter) sensor that measures toner charge or an ETAC (electronic toner area coverage) sensor that measures the photoreceptor/toner reflectance. (It is noted that Instead of using a sensor, the nip width can also be obtained by making a physical measurement on the transfer media.) The nip width value attained using the present invention, is compared to predetermined nip width values for the cleaning brush to determine if a failure has occurred with the cleaning brush. The predetermined nip width values are devised based upon brush characteristics including brush diameter and photoreceptor interference. For example, a 30 mm diameter brush has a nominal nip width equal to 15 mm (2 mm BPI), a minimum nip width equal to 10.8 mm (1 mm BPI) and a maximum nip width equal to 16.6 mm (2.5 mm BPI). A cleaner brush failure, for these parameters, is deemed to occur when the measured nip width falls outside of the predetermined 10.8 mm to 16.6 mm range (i.e. outside of the minimum/maximum range values).

Finally, the nip width measurement is converted into information that can be used to determine the preventive or repair actions needed in the machine. The nip width value provides useful diagnostic information such as an automatic diagnostic tool for a technical representative that provides an end of brush life warning to a technical representative or a service branch through RIC. This nip width measurement provides parameters that can be adapted to prolong brush life and reduce expensive unscheduled maintenance calls (UMs). Software algorithms are but one method of converting nip width measurements into useful diagnostic information.

It is noted that variations may be made to this basic procedure. The following examples are three such variations in the present invention. After developing a toner patch 90 of sufficient width to overlap the brush 100 (or brushes) on the photoreceptor 10 surface, the toner patch on the moving photoreceptor is moved under or into alignment with the cleaner brush (or brushes) which has been retracted away from the photoreceptor. Next, the brush is engaged with the stationary photoreceptor and rotated against the photoreceptor. Then the brush is once again retracted so that the toner patch is not disturbed before a measurement can be made of the nip width. Then the measurement and conversion steps previously described, occur at this time.

Referring to FIG. 1B, an alternate embodiment of the present invention, is to develop a toner patch 90 of sufficient width to overlap the brush 100 (or brushes) on the photoreceptor 10 surface. The toner patch 90 is then moved under the brush and the brush is biased electrostatically to the same polarity as the toner to prevent cleaning of the toner by the non rotating brush or brushes. In the next step of this embodiment, the bias is removed from the brush and the brush is then rotated against the stationary photoreceptor 10. Next, during removal of the toner patch from under the electrostatic brush is once again biased to the same polarity as the toner so as not to remove toner from the toner patch 90 by the brush before a measurement is made. The measurement and conversion steps described above would then occur at this point.

Another embodiment of the present invention is to develop the toner patch 90 of sufficient width to overlap the brush 100 (see FIG. 1A) (or brushes—see FIG. 5) on the photoreceptor surface. Then, the brush is stopped from rotating and no bias is applied to the brush as the toner patch is moved under the cleaning brush or brushes. The brush fibers dragging through the toner pile will disturb but not remove the toner with the exception that some of the lead edge of the toner patch may be removed. The brushes are then rotated against the stationary photoreceptor while the detoning device (e.g. air, flicker bar, detoning roll 105—see FIG. 1B) is disabled. Next the toner patch is removed from alignment or under the cleaner brush while the brush is not rotating nor having a biased applied to the brush. The poor detoning of the stationary brush (i.e. because the detone has been disabled) prevents significant disturbance of the toner patch in the nip. The measurement and conversion steps described above would then occur at this point.

Figure 2A:
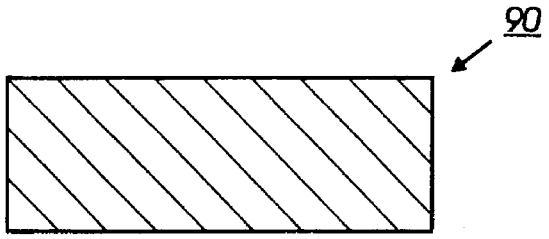
FIG. 2A is a topical schematic of a developed toner patch, shown as a side view in FIG. 1A.
Figure 2B:
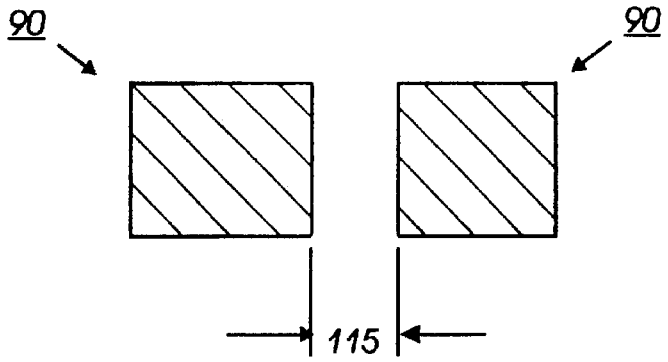
FIG. 2B is a topical schematic view of a developed toner patch with a nip width of toner removed from the patch by a new cleaning brush.
Figure 2C:
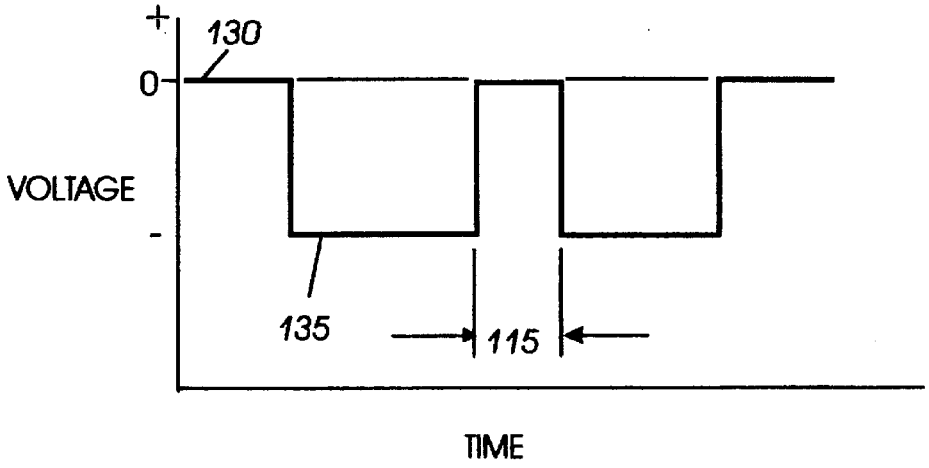
FIG. 2C is an ESV trace, from the present invention, to determine the cleaned nip width measurement of FIG. 2B for a "new" cleaner brush.
Figure 3A:
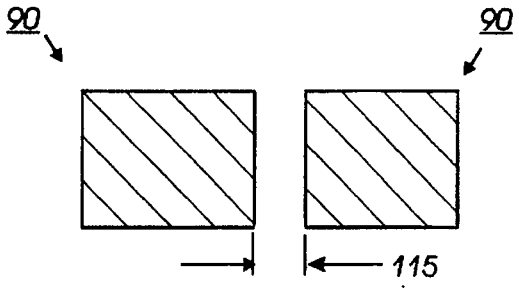
FIG. 3A is a topical schematic view of a developed toner patch with a cleaned nip width created by a "used" cleaner brush.
Figure 3B:
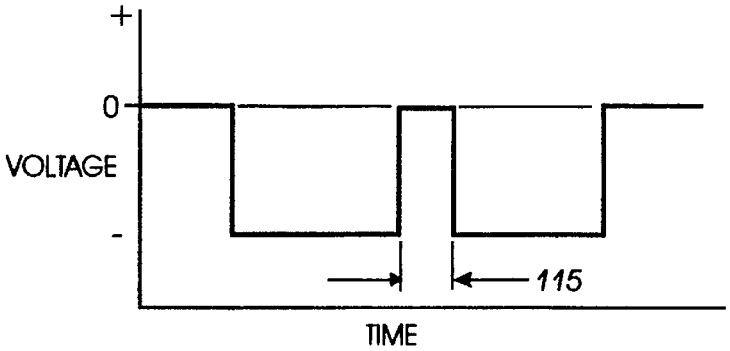
FIG. 3B is an ESV trace, from the present invention, to determine the cleaned nip width measurement of the "used" brush of FIG. 3A.
Figure 4A:
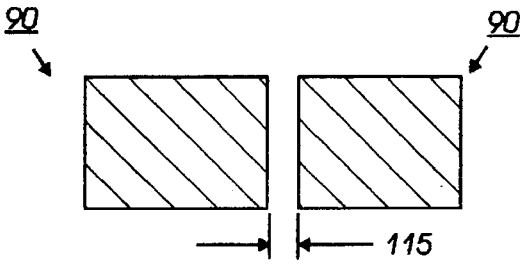
FIG. 4A is a topical schematic view of a developed toner patch with a cleaned nip width created by a "failed" cleaner brush.
Figure 4B:
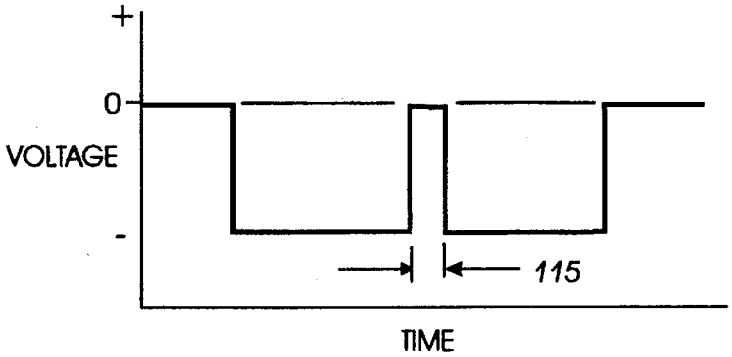
FIG. 4B is an ESV trace, from the present invention, to determine the cleaned nip width measurement of the "failed" brush of FIG. 4A.

FIGS. 2A–2C show a topical view of the developed toner patch and the nip width (FIG. 2B) and measurement for a new brush (FIG. 2C). FIG. 2C shows an ESV trace relative to the nip width of FIG. 2C. The upper line of the trace 130 shows the value for the discharged photoreceptor after being electrically discharged by an erase lamp. The lower value 135 of the trace shows the negative voltage of the negative charged toner. FIGS. 3A and 3B show the nip width for toner removed by a used brush and the corresponding ESV trace, respectively. FIGS. 4A and 4B show the nip width for toner removed by a failed brush and the corresponding ESV trace, respectively. This nip width of the failed brush is detected by the sensing device which triggers a service code RIC call or an adjustment to the relevant cleaner parameter. The nip width measurement of the new brush is greater than the nip width of the used brush which is greater than the nip width of the failed brush.

In recapitulation, the present invention utilizes a separate photoreceptor and cleaner drives to enable automatic measurement of cleaning brush contact areas against the photoreceptor. A developed toner patch positioned directly adjacent to (e.g. under) the cleaner brush is cleaned by the brush in the contact zone between the brush and the photoreceptor. The width of the cleaned contact zones are measured with an ESV (electrostatic voltmeter) or ETAC (electronic toner area coverage sensor). As the contact zone cleaned by the cleaner brush decreases, the likelihood of failure of the brush resulting in copy quality defects increases. The measurement of the contact zone indicated reduced cleaning performance due to loss of contact over time. This information is used as an automated diagnostic procedure or to alter cleaner operation for better performance or to indicate a need to replace the brush(es).

It is, therefore, apparent that there has been provided in accordance with the present invention, an automatic measurement of cleaning brush nip that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for measuring a width of a contact zone between a surface, having movement, and a cleaner brush, having a detoning member, the surface having a toner image thereon, the contact zone having particles of the toner image removed from the surface, comprising:

developing the toner image on the surface, the toner image having sufficient width to overlap the cleaner brush;

moving the toner image into direct alignment with the cleaner brush;

stopping the movement of the surface;

rotating the cleaner brush against the surface to remove the toner image from the surface in the contact zone;

moving the toner image out of direct alignment with the cleaner brush;

measuring a width of the contact zone automatically; and converting the measurement of the width of the contact zone for diagnostic analysis and process control.

2. A method as recited in claim 1, wherein the step of measuring a width of the contact zone automatically, comprises the steps of using a sensing device to determine an amount of time required for two edges of the contact zone on the imaging surface to pass under the sensing device, the two edges having a lead edge and a trail edge separated by the width of the contact zone away from one another.

3. A method as recited in claim 1, wherein the step of moving the toner image into direct alignment with the cleaner brush comprises the step of retracting the cleaner brush from the surface.

4. A method as recited in claim 3, wherein the step of rotating the cleaner brush against the surface comprises the step of engaging the cleaner brush with the surface having the toner image thereon.

5. A method as recited in claim 4, wherein the step of moving the toner image out of direct alignment with the cleaner brush comprises the steps of:

retracting the cleaner brush away from contact with the surface; and restarting movement of the surface to move the cleaner brush out of direct alignment with the cleaner brush.

6. A method as recited in claim 1, wherein the step of moving the toner image into direct alignment with the cleaner brush comprises the steps of:

stopping rotation of the cleaner brush; and biasing the cleaner brush to the same polarity as the toner image to prevent removal of the toner image by the cleaner brush in a non-rotating mode.

7. A method as recited in claim 6, wherein the step of rotating the cleaner brush against the surface comprises the steps of:

rotating the cleaner brush; and removing the bias on the cleaner brush during rotation of the cleaner brush against the surface to remove the toner image in the contact zone.

8. A method as recited in claim 7, wherein the step of moving the toner image out of direct alignment with the cleaner brush comprises the steps of:

biasing the cleaner brush to the same polarity as the toner image; and restarting movement of the surface to move the cleaner brush out of direct alignment with the cleaner brush.

9. A method as recited in claim 1, wherein the step of moving the toner image comprises the step of stopping rotation of the cleaner brush.

10. A method as recited in claim 9, wherein the step of rotating the cleaner brush against the surface comprises the step of disabling the detoning member adjacent to the cleaner brush for removing the particles cleaned from the surface, from the cleaner brush.

11. A method as recited in claim 10, wherein the step of moving the toner image out of direct alignment with the cleaner brush comprises the steps of:

stopping rotation of the cleaner brush; and restarting movement of the surface to move the cleaner brush out of direct alignment with the cleaner brush.

12. A method as recited in claim 2, wherein the step of using a sensing device comprises using an optical sensor.

13. A method as recited in claim 2, wherein the step of using a sensing device comprises measuring the charge of the toner image.

14. A method as recited in claim 2, wherein the step of using a sensing device comprises measuring the difference between an area of the surface having a toner image thereon causing a first reflectance and an area of the surface having the toner image removed thereon causing a second reflectance greater than the first reflectance.

15. A method as recited in claim 2, wherein the step of converting the measurement of the width of the contact zone for diagnostic analysis and process control comprises the step of adapting parameters of the cleaner brush to prolong life of the cleaner brush based upon the contact zone width detected by the sensing device being outside a range of predetermined contact zone width values.

16. A method as recited in claim 2, wherein the step of converting the measurement of the width of the contact zone for diagnostic analysis and process control comprises the step of signaling an end of brush life warning.

* * * * *